US008967749B2

(12) United States Patent
Nunokawa et al.

(10) Patent No.: US 8,967,749 B2
(45) Date of Patent: Mar. 3, 2015

(54) PRINTING DEVICE

(71) Applicant: Seiko Epson Corporation, Tokyo (JP)

(72) Inventors: Yohei Nunokawa, Nagano (JP); Yasuhiko Yoshihisa, Nagano (JP); Hitoshi Igarashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/960,055

(22) Filed: Aug. 6, 2013

(65) Prior Publication Data

US 2014/0043383 A1 Feb. 13, 2014

(30) Foreign Application Priority Data

Aug. 7, 2012 (JP) ..... 2012-174690

(51) Int. Cl.
*B41J 2/11* (2006.01)
*B41J 13/00* (2006.01)

(52) U.S. Cl.
CPC ..... *B41J 2/11* (2013.01); *B41J 13/0009* (2013.01)
USPC ..... 347/9; 347/14

(58) Field of Classification Search
CPC ..... B41J 29/38; B41J 11/007; B41J 13/0009
USPC ..... 347/9, 12, 14, 16, 40, 54, 101
See application file for complete search history.

(56) References Cited

U.S. PATENT DOCUMENTS 5,719,602 A * 2/1998 Hackleman et al. ..... 347/14
8,511,780 B2 * 8/2013 Akiyama et al. ..... 347/16
2005/0058480 A1 3/2005 Ohashi et al.

FOREIGN PATENT DOCUMENTS

JP 2010-047014 A 3/2010

* cited by examiner

*Primary Examiner* — Thinh Nguyen
(74) *Attorney, Agent, or Firm* — Global IP Counselors, LLP

(57) ABSTRACT

To reduce noise during paper conveyance while ensuring printing efficiency of an inkjet printer, a printing device is equipped with a control unit for moving a recording head back and forth in the scan direction according to the rotation of a carriage motor, a conveyance unit for extracting and feeding paper, conveying the paper in the sub scan direction to match the movement of the recording head to print the fed paper, and ejecting the printed paper according to the rotation of a conveyance motor, a paper reversal unit for coordinating with the rotation of the rotation means of the conveyance motor to reverse the front and back of the paper, and a printing control unit for controlling spraying of the ink from the recording head, as well as controlling the carriage motor and the conveyance motor.

7 Claims, 8 Drawing Sheets

| STEP \ MODE | NORMAL MODE | QUIET MODE |
|---|---|---|
| PAPER EXTRACTION | a | sa |
| PAPER CONVEYANCE | b | sb |
| PRINTING | c | sc |
| REVERSAL CONVEYANCE | d | sd |
| EJECTION | e | se |

Fig. 6

PRINTING DEVICE

CROSS-REFERENCE TO RELATED APPLICATIONS

This application claims priority to Japanese Patent Application No. 2012-174690 filed on Aug. 7, 2012. The entire disclosure of Japanese Patent Application No. 2012-174690 is hereby incorporated herein by reference.

BACKGROUND

1. Technical Field

The present invention relates to a printing device.

2. Background Technology

As with an ink jet printer, with a printing device for which a recording head that discharges ink drops is scanned over media it faces opposite to print, printing is done with paper feeding of paper from a feed cassette or a tray in which sheet form paper is housed, and the printed paper is ejected to a stacker. In recent years, as shown in Patent Document 1 noted hereafter, models that have built in devices for reversing the front and back of the paper, and models for which it is possible to mount a plurality of feed cassettes of different paper sizes have been manufactured, and there was a tendency for the paper conveyance path to become complex and for the conveyance path to become long. With this kind of model, with improvement of the processing capacity of the ink jet printer as a countermeasure, an attempt was made to shorten the time needed for conveying by accelerating the conveyance speed for conveying in the conveyance path.

Japanese Laid-open Patent Publication No. 2010-47014 (Patent Document 1) is an example of the related art.

SUMMARY

Problems to Be Solved by the Invention

However, by making the conveyance speed fast, noise occurred from the sliding part of the ink jet printer, and this was unpleasant for people in the vicinity. Also, when the conveyance speed was reduced in order to reduce noise from the ink jet printer, the printing efficiency of the ink jet printer decreased.

Means Used to Solve the Above-Mentioned Problems

The invention was creased to address at least a part of the problems described above, and can be realized in the following modes or application examples.

Application Example 1

The printing device of this application example is a printing device for spraying ink drops on media that faces opposite a recording head that moves in the scanning direction and that moves in the sub scan direction orthogonal to the scan direction to do printing based on print job data, equipped with a scan unit that moves the recording head back and forth in the scan direction according to the rotation of a first rotation means, a conveyance unit that extracts the media and supplies it according to the rotation of a second rotation means, conveys the media in the sub scan direction to match the movement of the recording head in order to print on the supplied media, and ejects the printed media, a reversal unit that works together with the rotation of the second rotation means and reverses the front and back of the media, and a control unit that controls the spraying of the ink drops from the recording head, the rotation of the first rotation means, and the rotation of the second rotation means, wherein the control unit switches the rotation speed of the second rotation means according to the accumulated number of sheets obtained by counting the number of media sheets printed based on the print job data when the print job data indicates printing on a plurality of sheets of the media.

With this kind of constitution, the rotation speed of the second rotation means is switched according to the accumulated sheet count obtained by counting the number of sheets of media printed based on the print job data, so the conveyance speed of the media changes according to the accumulated sheet count. Therefore, by appropriately changing the conveyance speed of the media according to the accumulated sheet count, it is possible to control the noise generated from the printing device and the printing efficiency of the printing device with good balance.

Application Example 2

With the printing device of the application example noted above, it is preferable that the control unit rotate the second rotation means at the rotation speed according to a first mode when the accumulated sheet count is less than a standard sheet count, and rotate the second rotation means at the rotation speed according to a second mode for conveying the media at a faster speed than the first mode when the accumulated sheet count is the standard sheet count or greater.

With this kind of constitution, the rotation speed when the printed accumulated sheet count is low is a slower speed than the rotation speed when the accumulated sheet count is high, so it is possible to suppress the noise from when printing starts until the standard sheet count is reached, and to improve the printing efficiency after the standard sheet count is exceeded.

Application Example 3

With the printing device of the application example noted above, it is preferable that the control unit switch the rotation speed corresponding to at least one of a first speed for the conveyance unit to extract the media, a second speed for conveying the extracted media to a printing position, a third speed for cooperating with the recording head that moves in the scan direction to move the media in the sub scan direction to print, a fourth speed for reversing the front and back of the printed media, and a fifth speed for ejecting the printed media.

With this kind of constitution, it is possible to do conveying efficiently by setting the rotation speed for each conveyance step.

Application Example 4

With the printing device of the application example noted above, when printing based on the second print job data within a designated elapsed time after the media has been printed based on the first print job data and ejected, it is also possible for the control unit to sum up the number of sheets for the first print job data to count.

Application Example 5

With the printing device of the application example noted above, it is also possible for the standard sheet count to be changed by a designated operation.

BRIEF DESCRIPTION OF THE DRAWINGS

Referring now to the attached drawings which form a part of this original disclosure:

FIG. 6 is a drawing showing an example of a speed table;

DETAILED DESCRIPTION OF EXEMPLARY EMBODIMENTS

Figure 1:
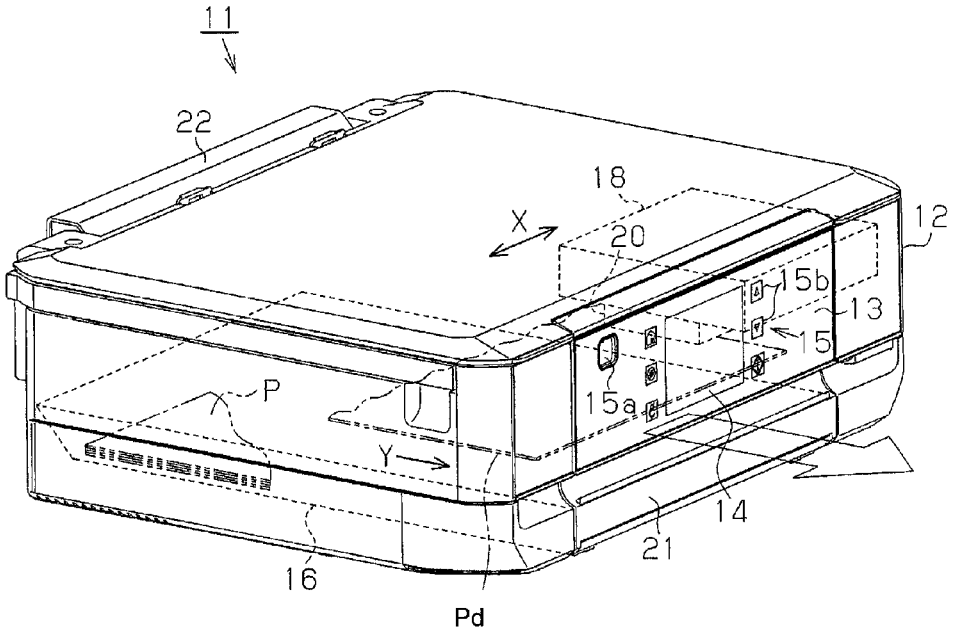
FIG. 1 is a perspective view of a printer of an embodiment of the invention.

Following, we will describe an embodiment of the invention while referring to the drawings.

Embodiment

Following, we will describe an embodiment with the printing device in a specific form as a printer based on FIG. 1 through FIG. 8.

FIG. 1 is a perspective view of the printer of this embodiment. As shown in this FIG. 1, the printer 11 is equipped with a device main unit 12 having a roughly rectangular solid shape, and an operating panel 13 used for input operation by the user provided on the front surface (right surface in FIG. 1) of the device main unit 12. The operating panel 13 is constituted to be able to rotate forward in relation to the front surface of the device main unit 12 with its top part as the rotation axis. A display unit 14 consisting of a liquid crystal panel or the like and an operating panel 15 consisting of a plurality of operating switches are equipped on the operating panel 13. Included in the operating unit 15 are a power switch 15*a* for doing the on/off operation of the print 11 power, a selection switch 15*b* for doing the selection operation of desired selection items on the menu screen displayed on the display unit 14 and the like.

Also, a feed cassette 16 in which multiple sheets of paper P as an example of the media can be housed is mounted in a detachable state (able to be inserted and removed) at the bottom side position of the operating panel 13 on the front surface of the device main unit 12. Inside the device main unit 12, the carriage 18 is grasped and guided by a pair of guide rails 19 (see FIG. 3) built so as to extend in the scan direction X orthogonal to the conveyance direction Y, and is provided in a state by which it can move back and forth along the scan direction X. A recording head 20 for printing using the ink jet method is attached to the bottom part of the carriage 18. This recording head 20 has a plurality of nozzles for spraying ink drops on the conveyed paper P.

The already printed paper Pd is ejected in the direction shown by the white outline arrow in FIG. 1 from an ejection port exposed when a cover 21 is in an open state, the cover provided in a rotatable state with the bottom part as the rotation axis on the front surface of the feed cassette 16. At this time, a stacker 23 (see FIG. 2), which is a roughly square flat shaped single tray housed inside the device main unit 12, is pulled out in advance to the outside direction of the device main unit 12 from the cover 21, and the ejected already printed paper Pd is ejected onto the stacker 23. Moreover, on the back part of the device main unit 12 is provided an opening and closing type cover 22 that closes the insertion port for which insertion is possible by manual feeding of the paper P, and it is also possible to open this cover 22 and insert the paper P by hand feeding from the insertion port.

Figure 2:
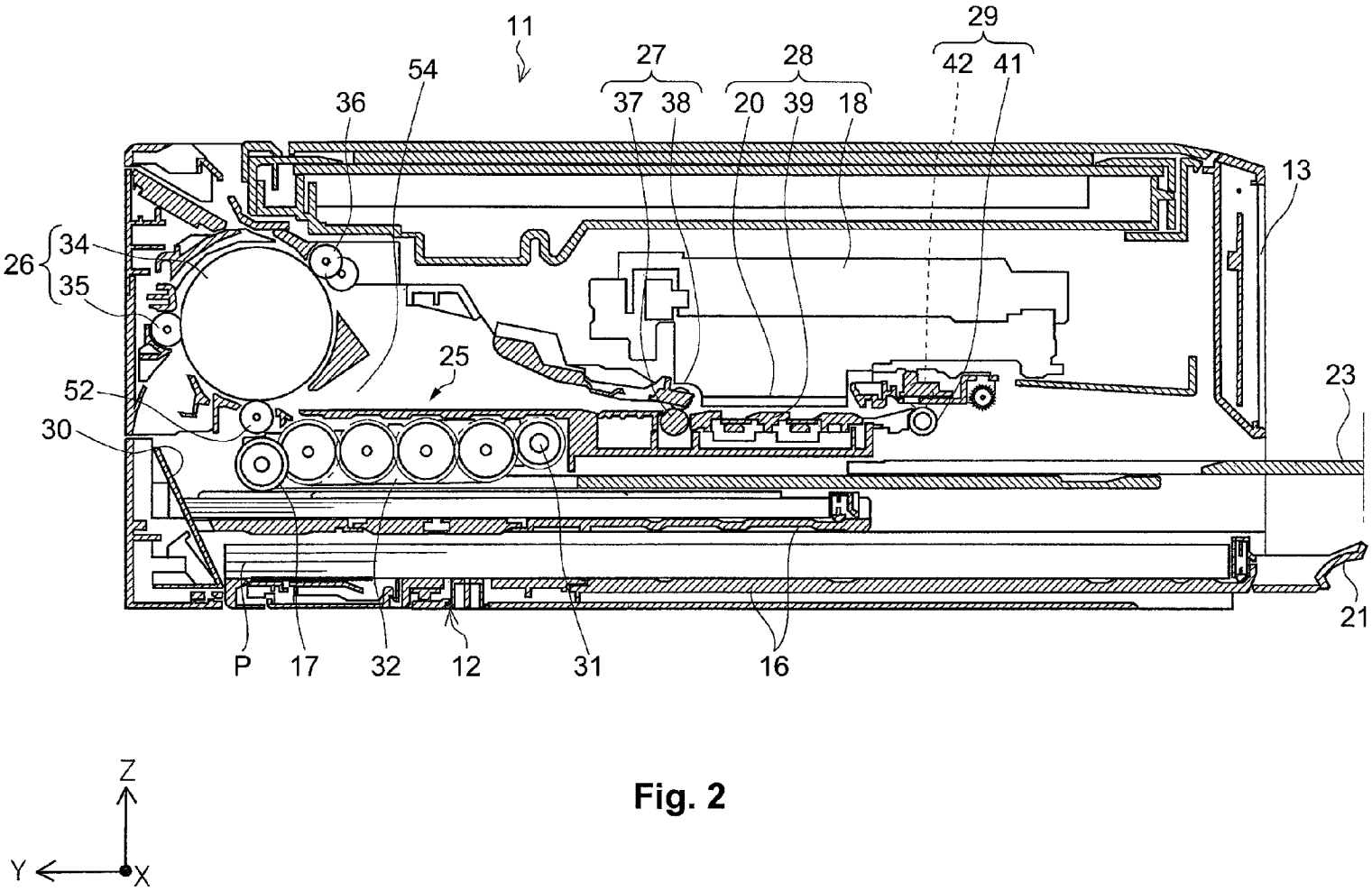
FIG. 2 is a side cross section view showing the paper conveyance path of the printer of the embodiment of the invention.

Next, we will describe the structural elements on the paper conveyance path while referring to FIG. 2. Moreover, with FIG. 2, the stacker 23 is driven, and the cover 21 is opened by being pressed by the stacker 23 projecting midway from the device main unit 12. As shown in FIG. 2, the device main unit 12 is equipped with a cassette feed unit 25, a feed unit 26, a media conveyance unit 27, a recording unit 28, and a forwarding unit 29. Among these, the cassette feed unit 25, the feed unit 26, the media conveyance unit 27, and the forwarding unit 29 function as the conveyance unit that conveys the paper P. The conveyance unit is constituted so that the power is transmitted from the conveyance motor 33 (see FIG. 5) which is the second rotation means via a gear train means such as gears or the like. The cassette feed unit 25 is equipped with a feed cassette 16, a pickup roller 17 provided above the feed cassette 16, and a separation unit 30 provided at a position facing opposite the front edge of the paper P housed in the feed cassette 16.

The pickup roller 17 is provided on a swing unit 32 that swings with a swing axis 31 as the center, and is rotationally driven by the force transmitted from the conveyance motor 33. The pickup roller 17 feeds the topmost paper P from the feed cassette 16 to the feed path by contacting the topmost paper P of the paper P housed in the feed cassette 16 and rotating. At this time, the topmost paper P sent out from the feed cassette 16 by the rotation of the pickup roller 17 is separated from the next paper P and thereafter by the separation unit 30.

A feed unit 26 provided on the feed path downstream side of the separation unit 30 is equipped with a feed drive roller 34 driven by the conveyance motor 33, a separation roller 35, and a feed driven roller 36. The separation roller 35 ejects the topmost paper P by contacting the feed drive roller 34 and performing separation again in relation to the paper P, and reliably sends only the topmost ejected paper P to the feed path downstream side.

Also, the paper P grasped between the feed drive roller 34 and the feed driven roller 36 is conveyed to the media conveyance unit 27. The media conveyance unit 27 is equipped with a conveyance drive roller 37 similarly driven by the conveyance motor 33, and a conveyance driven roller 38 which is in pressure contact with the conveyance drive roller 37 and driven to rotate. The paper P is sent further to the downstream side by the media conveyance unit 27. Using the mechanism described above, the paper P is separated from the feed cassette 16 in which it is housed and fed (supplied) to the printing area.

The recording unit 28 provided in the printing area, specifically at the downstream side of the media conveyance unit 27, is equipped with the carriage 18, the recording head 20, and a support platform 39 facing opposite the recording head 20. In the process of the carriage 18 moving back and forth in the scan direction (X direction) while being guided by the pair of guide rails 19 by the power of the carriage motor 40 (see FIG. 5) which is the first rotation means, the recording head 20 selectively sprays a plurality of ink drops on the paper P. At this time, by the conveyance motor 33 rotating in one direction, an image is formed on the paper P moving in the sub scan direction (−Y direction) which is the paper P conveyance direction. At this time, the top surface of the support platform 39 functions as a support surface for supporting the paper P. Moreover, the carriage motor 40 and the pair of guide rails 19 constitute the scanning unit.

The forwarding unit 29 provided at the downstream side of the support platform 39 is equipped with a first roller 41 driven by the conveyance motor 33, and a second roller 42 in contact with the first roller 41 and driven to rotate. Then, the paper Pd for which recording was performed is forwarded by the forwarding unit 29. Working in this way, the paper Pd recorded by the recording unit 28 is grasped by the first roller 41 and the second roller 42, and is ejected to the stacker 23 provided on the front surface side of the device main unit 12.

Also, with this printer 11, a paper reversal unit 50 (see FIG. 5) is equipped as a reversal unit for reversing the paper P when performing printing on both the back and front surfaces of the paper P. Here, we will describe the paper P reversal method. After recording on one side of the paper P by the recording unit 28, with the paper P, the side which is the paper back edge when recording is executed on one side becomes the front edge and is returned to the upstream side of the media conveyance unit 28 by the reverse feed operation of the media conveyance unit 27 and the forwarding unit 29. Furthermore, the paper P is sent to a reversal path 54 by the reverse feed operation of the media conveyance unit 27. The paper P sent within the reversal path 54 is grasped by the feed drive roller 34 and the reversal roller 52 and returned again to the feed path.

Figure 3:
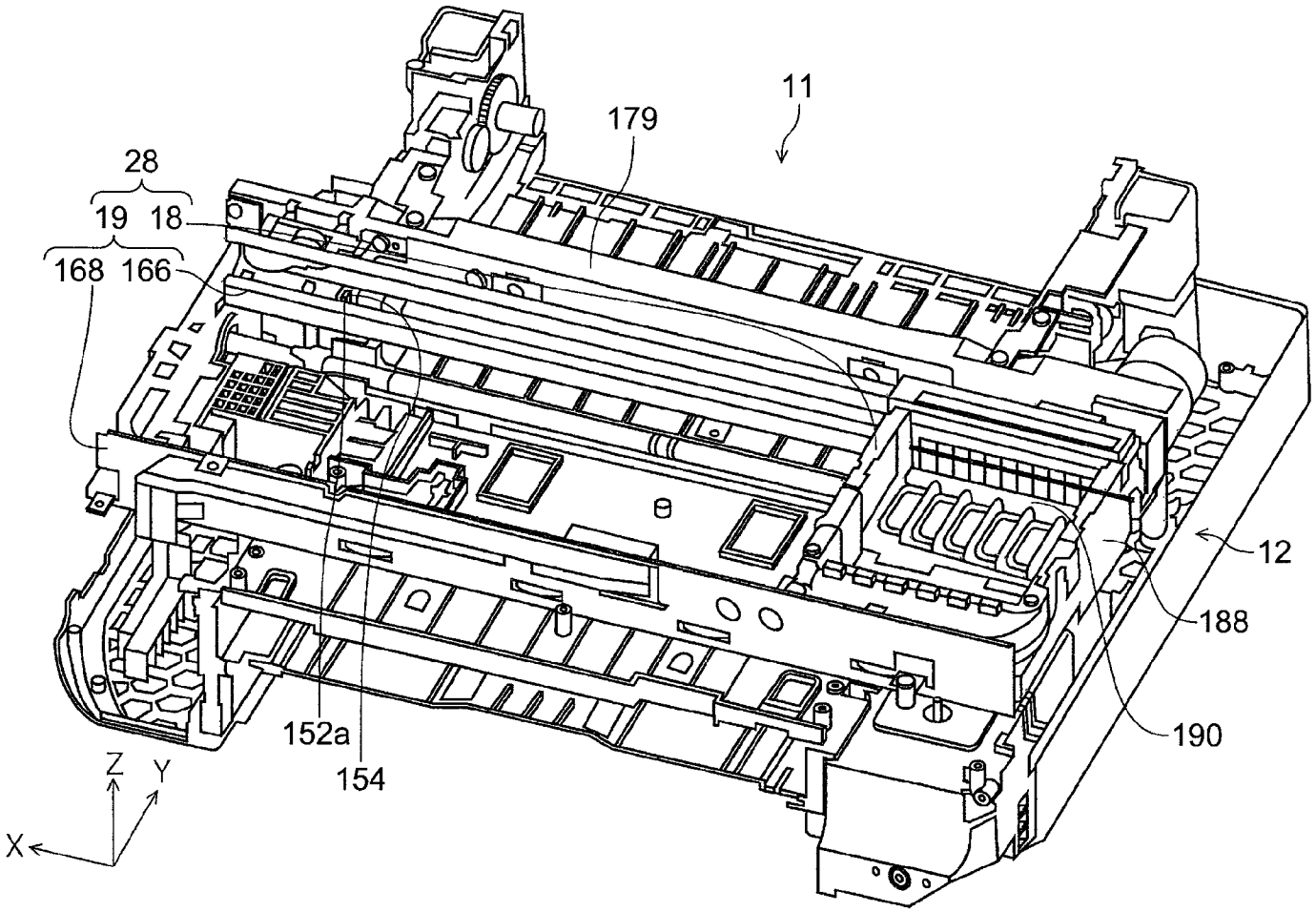
FIG. 3 is a perspective view showing the interior of the printer of the embodiment of the invention.

The paper P returned to the feed path is again sent to the media conveyance unit 27 further to the feed path downstream side by the feed drive roller 34 via the separation roller 35 and the feed driven roller 36. At this time, the one side and the other side of the paper P are reversed with a curve, and the other side faces opposite the recording head 20. The paper P is sent to the recording unit 28 by the media conveyance unit 27. The paper P for which recording is performed on the other side by the recording unit 28 is grasped by the forwarding unit 29, and is ejected to the stacker 23 provided on the device front side. Next, FIG. 3 is a perspective view of the printer 11. The carriage 18 of the recording unit 28 moves back and forth in the scan direction guided by the pair of guide rails 19 as the "guide member" extending in the scan direction of the recording head 20. The pair of guide rails 19 is equipped with a main guide rail 166 attached to the device main unit 12 at the device back surface side, specifically, the +Y direction side, and a sub guide rail 168 attached to the device main unit 12 at the device front surface side, specifically, the −Y direction side, and these hold the carriage 18 with a bridging structure.

Figure 4:
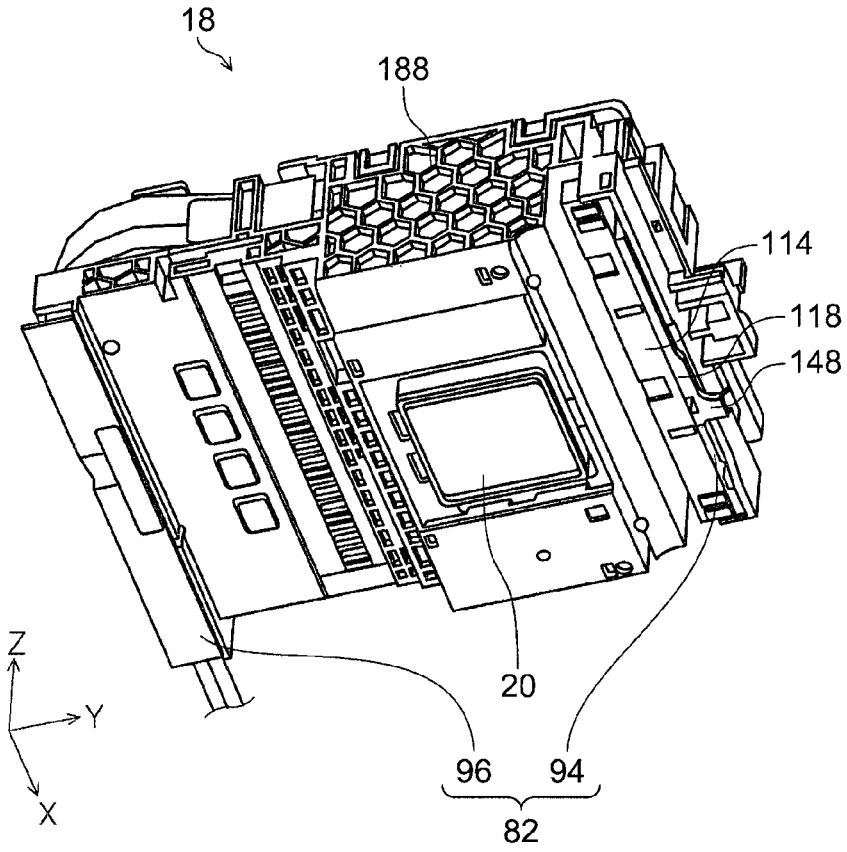
FIG. 4 is a perspective view of the carriage seen from the housing bottom surface side.

Next, FIG. 4 is a perspective view of the carriage 18 seen from the bottom surface side of the device main unit 12. This carriage 18 is equipped with a housing 188, an ink cartridge housing unit 190 provided on the top part of the housing 188 for housing a plurality of ink cartridges, the recording head 20 arranged so as to face opposite the support platform 39 at an opening part provided on the bottom part of the housing 188, and a gap adjustment unit 82 for adjusting the gap between the recording head 20 and the support surface of the support platform 39 that supports the paper P. This gap adjustment unit 82, though not illustrated, is constituted so that the gap changes within a designated range following the shape of an internally equipped cam when pressure is applied to the side bottom part of the housing 188.

Figure 5:
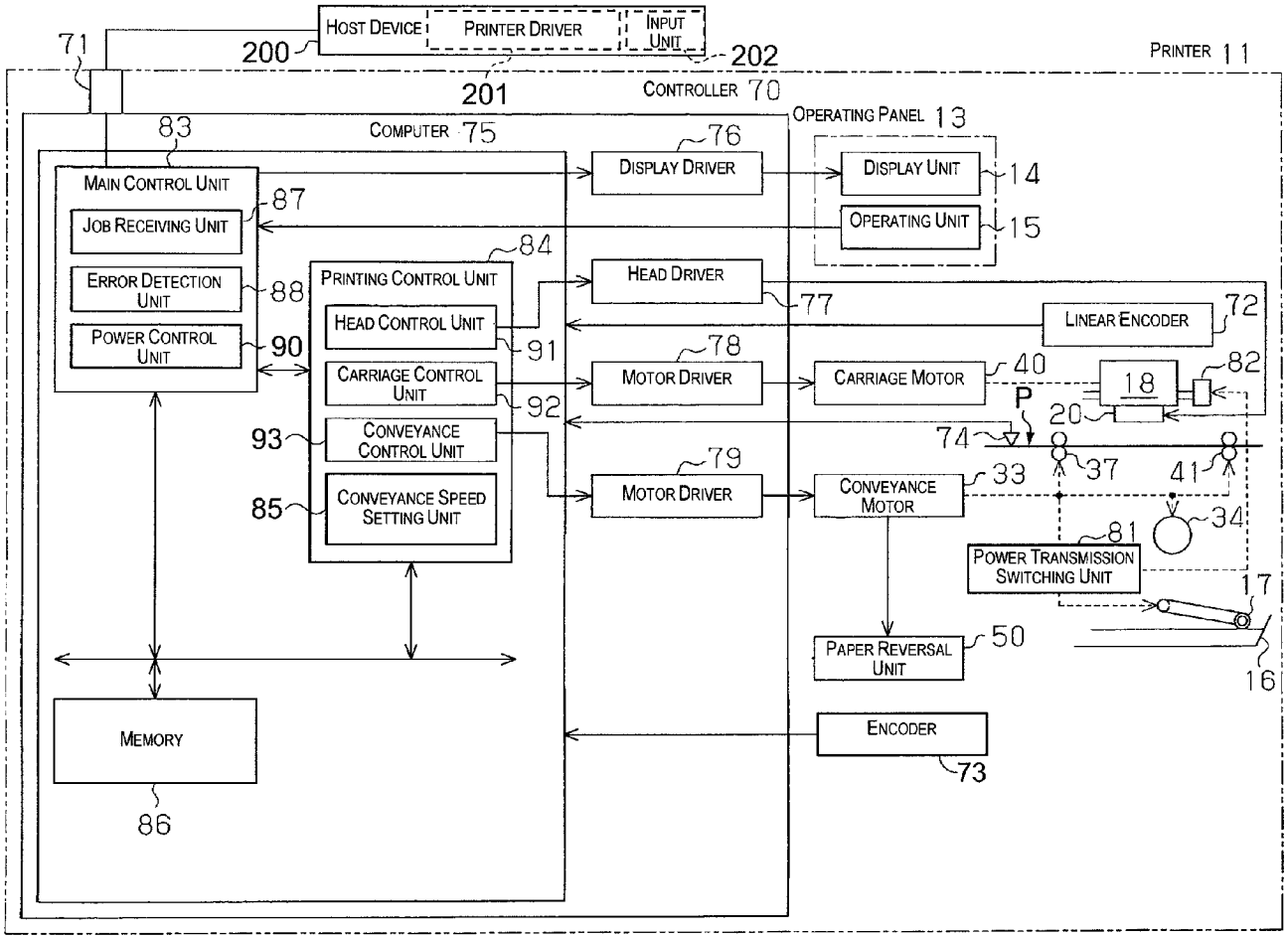
FIG. 5 is a block diagram showing the electrical configuration of the printer of the embodiment of the invention.

Next, we will describe the electrical configuration of the printer 11 based on FIG. 5. As shown in FIG. 5, the printer 11 is equipped with a controller 70 that is in charge of various controls. The controller 70 is connected to be able to communicate with the host device 200 via a communication interface 71. The controller 70 controls the printing operation of the printer 11 and the like based on the print job data received from the host device 200. The host device 200 is assumed to be a personal computer, for example, and has a printer driver 201 built in. The host device 200 is equipped with an input unit 202 consisting of a keyboard and a mouse, and by the user operating the input unit 202, printing condition information is input on the setting screen displayed by the printer driver 201 on a monitor (not illustrated). With this embodiment, the printing condition information includes settings such as the number of sheets to print, the paper type, the paper size, the printing mode indicating the printing quality, the two sided printing mode for performing printing on both the front and back surfaces and the like.

The printer driver 201 generates print image data of the image for which printing execution was indicated based on the printing condition information, generates print job data by adding the control command including the printing condition information as a header to the print image data, and sends the generated print job data to the printer 11. As an output system, a display unit 14, a carriage motor 40, and a conveyance motor 33 are connected to the controller 70. Also, as an input system, the operating unit 15 including the power switch 15*a*, a linear encoder 72, a rotary encoder 73, and a paper detection sensor 74 are connected to the controller 70.

Also, the controller 70 is equipped with a computer 75, a display driver 76, a head driver 77, and motor drivers 78 and 79. The computer 75 drives the recording head 20 via the head driver 77 based on the print job data, and by spraying ink drops from the recording head 20, draws an image or the like based on the printing image data. Also, the computer 75 does drive control of the carriage motor 40 via the motor driver 78, and controls the movement of the carriage 18 in the scan direction X. At this time, the computer 75 comprehends the movement position of the carriage 18 with the home position as the source point, for example, by counting the input pulses from the linear encoder 72 using a counter (not illustrated).

Furthermore, the computer 75 drives the conveyance motor 33 via the motor driver 79. Here, a power transmission switching unit 81 is interposed on the power transmission path of the conveyance motor 33. The power transmission switching unit 81 switches the transmission destination according to the rotation direction of the conveyance motor 33. Specifically, when the conveyance motor 33 rotates in one direction, the power transmission switching unit 81 rotates the switching lever (not illustrated) in one direction by rotation of the conveyance motor 33, and has it project in the movement area of the carriage 18. In this case, the conveyance motor 33 rotates the paper P in the conveyance direction from the downstream direction to the upstream direction. By the switching lever rotating, the state is such that it is possible to abut the gap adjustment unit 82, and in this state, when the carriage motor 40 is rotated, pressing force is transmitted to the gap adjustment unit 82.

Also, when the conveyance motor 33 rotates in the reverse direction to the one direction (forward direction), the power transmission switching unit 81 rotates the switching lever in the reverse direction and returns it to a non-abutting state. In this case, the conveyance motor 33 rotates in the direction that conveys the paper P from the upstream direction to the downstream direction.

Returning to FIG. 5, the gap adjustment unit 82 uses the pressing force transmitted from the switching lever based on instructions of the controller 70 and adjusts the gap by moving the recording head 20. The gap adjustment unit 82 moves the recording head 20 in the direction regulating the gap so that the distance between the spray surface of the recording head 20 and the media support surface is a designated set value according to printing condition information such as the media type, size, printing mode and the like.

The paper reversal unit 50 has the function of reversing the front and back of the paper P which is single sheet paper by the conveyance motor 33 and the reversal roller 52 performing a designated rotation based on instructions of the motor driver 79. The computer 75 prints on one side of the paper P initially when the print job data shows the two sided printing mode, and the printed paper P is received by the paper reversal unit 50 in a state grasped by the first roller 41, and the front and back are reversed. The reversed paper P is again conveyed to the recording unit 28, the other side is printed, and it is ejected.

The computer 75 shown in FIG. 5 is equipped with, for example, a CPU, ASIC (application specific IC), RAM, ROM, and non-volatile memory or the like. Various types of programs are stored in the ROM or non-volatile memory. With the computer 75, the plurality of functional units shown in FIG. 5 are realized by the CPU executing the programs stored in the ROM or non-volatile memory. With this embodiment, the computer 75 is equipped with a main control unit 83, a printing control unit 84, and a memory 86 as the plurality of functional units. These are not limited to being software constitutions using the computer 75, but can also be hardware constitutions of electronic circuits (e.g. custom ICs) or the like, or can be constituted by coordination of software and hardware.

The main control unit 83 is equipped with a job receiving unit 87, an error detection unit 88, and a power control unit 90. The job receiving unit 87 receives print job data from the host device 200, or receives print job data for printing image data input to the printer 11 from a portable memory device such as a memory card, USB memory or the like connected to the printer 11. The error detection unit 88 detects errors such as paper jams or the like, and the power control unit 90 controls the supply of power to each unit within the printer 11. Also, the printing control unit 84 is equipped with a head control unit 91, a carriage control unit 92, a conveyance control unit 93, and a conveyance speed setting unit 85.

The head control unit 91 controls the recording head 20 via the head driver 77 based on the printing image data received from the main control unit 83, and performs control to have the recording head 20 spray ink drops. The carriage control unit 92 controls the carriage motor 40 via the motor driver 78, and controls driving of the carriage 18 in the scan direction X. The conveyance control unit 93 controls the conveyance motor 33 via the motor driver 79, and controls the paper P feeding and conveyance, as well as the rotation of the switching lever. Moreover, the rotation speed of the conveyance motor 33 is instructed from the conveyance speed setting unit 85.

The conveyance speed setting unit 85 sets the conveyance speed for conveying the paper P by the conveyance motor 33 according to the printed sheet count printed with the first print job, and instructs the rotation speed corresponding to the set speed to the conveyance control unit 93. With this embodiment, the conveyance speed setting unit 85 holds the print counter function for counting the number of sheets printed internally, and the conveyance speed of the paper P to be printed next is switched according to the counted printed sheet count (accumulated sheet count). Moreover, for the conveyance speed, forwarding speeds from separating one sheet of the paper P housed in the feed cassette 16, conveying it to the printing area, and up to ejection after printing are assumed. Also, two modes are assumed for speed switching, a quiet mode (first mode) applied with the first print job until a designated printed sheet count is reached, and a normal mode (second mode) applied when the designated printed sheet count (standard sheet count) is exceeded, but the invention is not limited to two mode switching. The speed data for the quiet mode and the normal mode, for example as shown by the speed table shown in FIG. 5, are preset at conveyance speed corresponding to the respective steps of paper extraction, paper conveyance, printing, reverse conveyance, and ejection (first speed, second speed, third speed, fourth speed, and fifth speed). With the quiet mode, compared to the normal mode, the conveyance speed, specifically the rotation speed of the conveyance motor 33, is a lower speed, and in particular, the speed data is set so as to be able to reduce the noise level that occurs in the vicinity of the feed cassette 16 during paper feeding.

Moreover, the mode switching step can be a series of steps of the paper feed step up to before printing, the printing step, and the paper ejection step after printing, or it can be only one of the paper feed step or the paper ejection step. Also, the speed table can be made in even more detail according to the paper type, the paper size, the printing mode and the like, which are printing condition information. The conveyance speed setting unit 85 has the print sheet count shown by the printing counter reset to the initial value when the printing subject is new print job data. However, when the second print job data is printed within a designated time after the paper Pd already printed according to the first print job data is ejected, the conveyance speed setting unit 85 does not reset the count of the printed sheet count to the initial value, but rather sums up to count. Moreover, with this embodiment, 5 seconds is assumed as the designated time, but the time is not limited to this.

Figure 7:
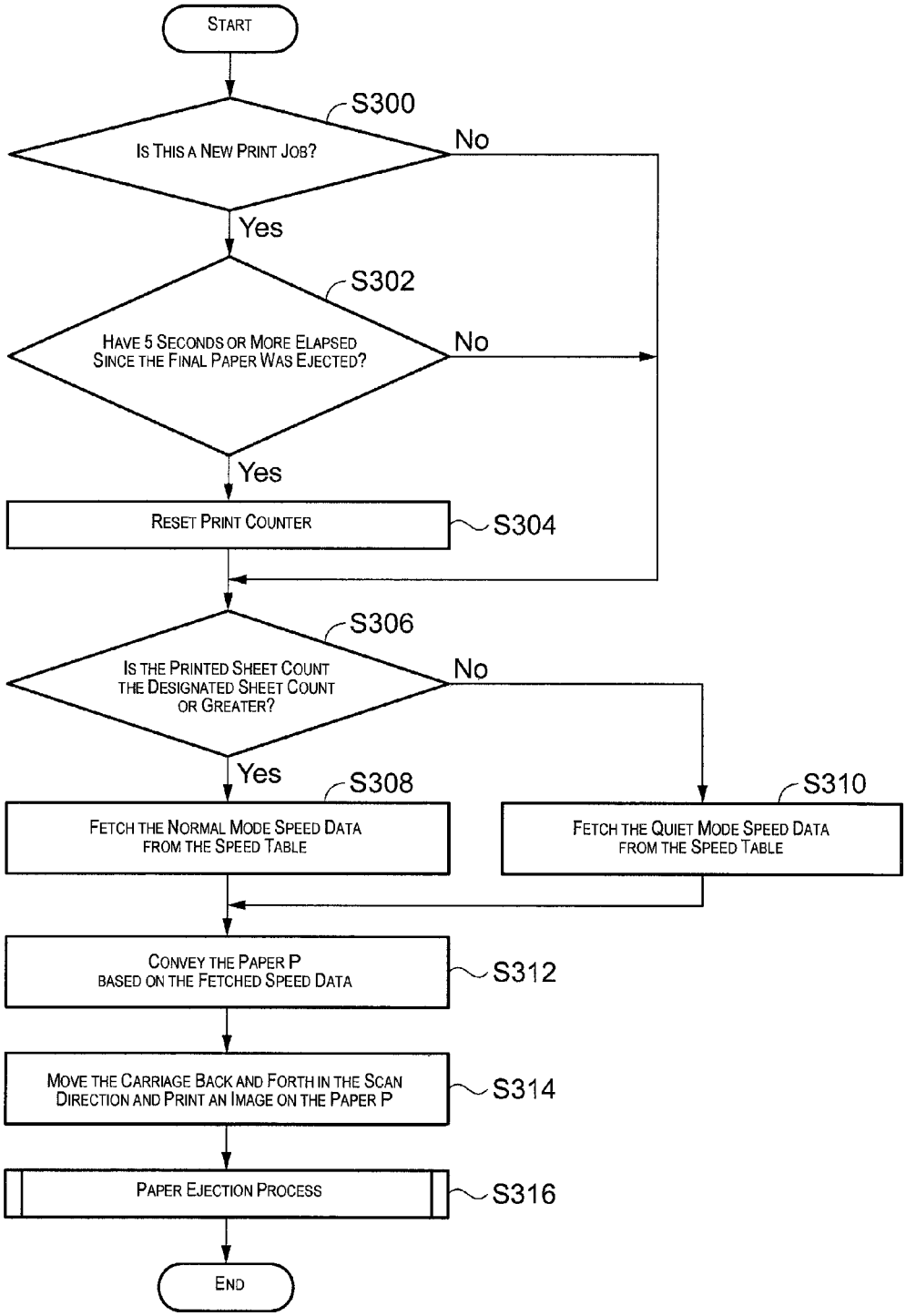
FIG. 7 is a flow chart showing the printing process of the printer.

The memory 86 assumes RAM or non-volatile memory. In the memory 86, reference data necessary for the control units 83 and 84 to perform various controls, such as the speed table or the like, are stored. Also, in the memory 86, the calculation results of the control units 83 and 84 and the status administration flags and the like are stored. FIG. 7 is a flow chart showing a series of printing processes of the printer 11. The process is executed when printing is performed on the printing paper P. When the process starts, the computer 75 judges whether or not this is print job data of a new print job (step S300). Here, when it is judged that this is not new print job data (No at step S300), the computer 75 advances to step S306. On the other hand, when it is judged that it is new print job data (Yes at step S300), the computer 75 judges whether 5 seconds or more have elapsed since the final already printed paper Pd was ejected (step S302).

Here, when it is judged that 5 seconds or more have not elapsed (No at step S302), the computer 75 advances to step S306. On the other hand, when it is judged that 5 seconds or more have elapsed (Yes at step S302), the computer 75 resets the printing counter to the initial value, and advances to step S306. At step S306, the computer 75 judges whether or not the print count is a designated printed sheet count or greater. Here, when it is judged that the print count is the designated printed sheet count or greater (Yes at step S306), the computer 75 fetches the normal mode speed data from the speed table (step S308), and advances to step S312. On the other hand, when it is judged that the print count is less than the designated printed sheet count (No at step S306), the computer 75 fetches the quiet mode speed data from the speed table (step S310) and advances to step S312.

Moreover, with this embodiment, the designated printed sheet count is 4. As a result, for the printing from the initial first sheet to the third sheet, quiet mode speed data is fetched, and from the fourth sheet and thereafter, the normal mode speed data is fetched. The reason that the designated printed sheet count was set to 4 is in order to try to make it quiet during printing for individual users assuming use in the home with a small printed sheet count, and to improve printing efficiency for corporate users assuming use in an office with a large printed sheet count. For example, as one embodiment, by making the quiet mode rotation speed about 25% slower than with the normal mode, the operating sound of the printer 11 is reduced from 50.4 db to 49.6 db. Moreover, this designated printed sheet count can be a fixed value, or it can be a mode set by the user from on a setting screen (not illustrated) of the printer driver 201, or it is possible to also assume a mode of setting it from the operating unit 15 of the operating panel 13.

Figure 8:
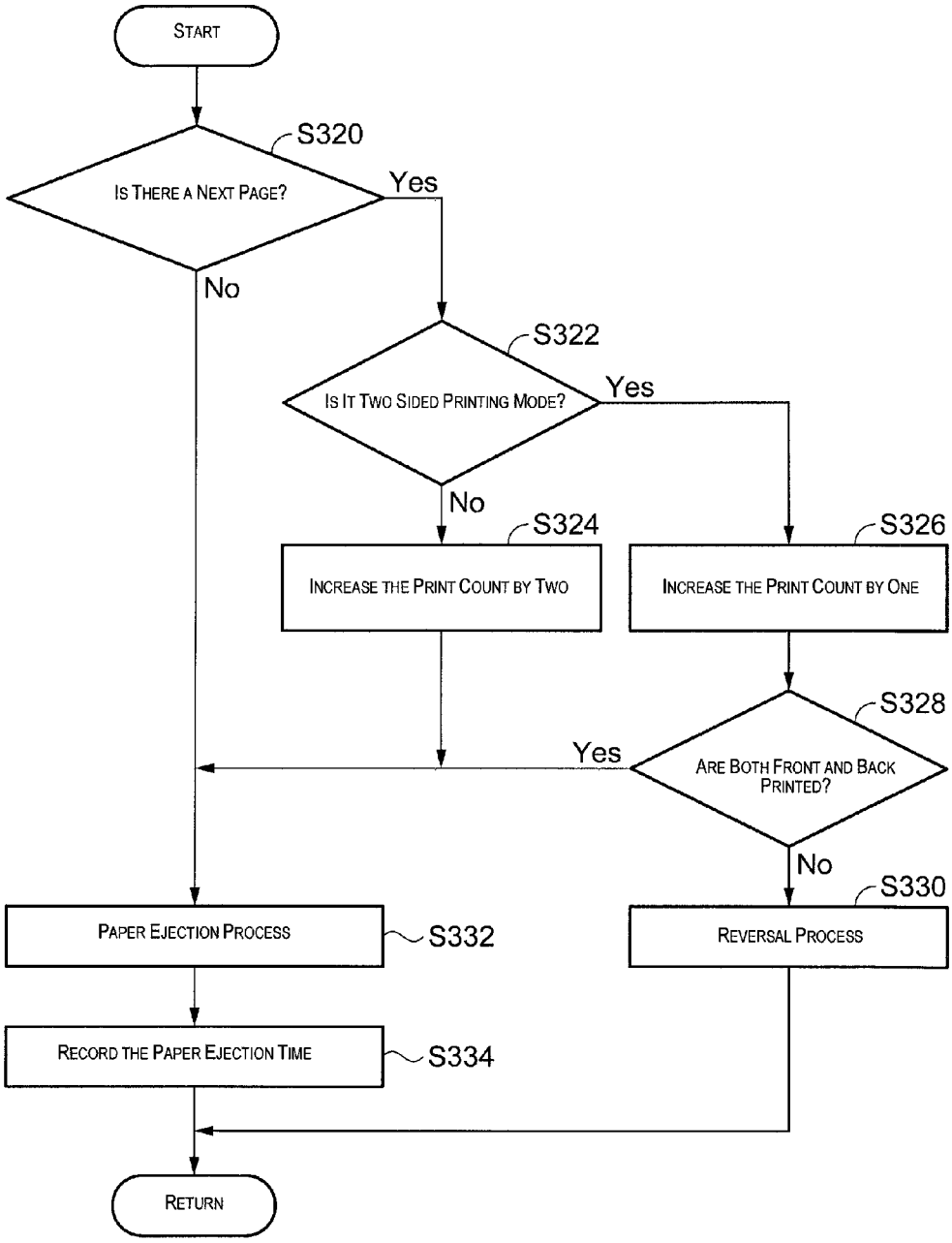
FIG. 8 is a flow chart showing the paper ejection process.

At step S312, the computer 75 separates the paper P housed in the feed cassette 16 and based on the fetched speed data, conveys the paper P to the printing area. Subsequently, the carriage 18 moves back and forth in the scan direction and ink drops are selectively sprayed, and an image is printed on the paper P (step S314). Next, the computer 75 executes the paper ejection process (step S316) and the series of processes ends. FIG. 8 is a flow chart showing the paper ejection process. Initially, the computer 75 judges whether or not there is a next page to be printed based on the print job data during the process (step S320). Here, when it is judged that there is no next page to be printed (No at step S320), it advances to step S332.

On the other hand, when it is judged that there is a next page to be printed (Yes at step S320), the computer 75 judges whether or not this is in the two sided printing mode (step S322). Here, when it is judged that this is not the two sided printing mode (No at step S322), the computer 75 increases the print count by two (step S324), and advances to step S332. On the other hand, when it is judged that it is the two sided printing mode (Yes at step S322), the computer 75 increases the print count by one (step S326), and judges whether or not both the front and back of the paper P have been printed (step S328).

Moreover, during two sided printing, the count is increased by one, and during one sided printing, the count is increased by two, so it is possible to correctly fetch the printed sheet count when it is either case of two sided printing or one sided printing. Here, when it is judged that both the front and back of the paper P have already been printed (Yes at step S328), it advances to step S332. At step S332, the ejection process of ejecting the already printed paper P in the printing area onto the stacker 23 is executed, the paper ejection timing is recorded (step S334), and the series of processes ends. On the other hand, when it is judged that one side of the paper P has already been printed but the other side has not been printed (No at step S328), the reversal process of reversing the front and back of the paper P for the other side of the printer P to be printed is executed (steep S330), and the series of paper ejection processes ends.

With the embodiment described above, the following kinds of effects are exhibited.

(1) When printing according to one print job data, from the initial first sheet to the third sheet, the paper P is conveyed in the quiet mode that makes the rotation speed of the conveyance motor 33 a slower speed, so it is possible to reduce the noise generated during conveyance, and from the fourth sheet and thereafter, the paper P is conveyed in the normal mode at a faster speed than the first sheet to the third sheet for the rotation speed of the conveyance motor 33, so it is possible to increase the printing efficiency, and thus it is possible to control the reduction of noise and the improvement of printing efficiency with good balance.

(2) For the speed data for the quiet mode and the normal mode, the conveyance speed is set according to each process in the speed table, so it is possible to instruct an optimal speed for each process.

For the device for implementing the kinds of methods described above, there are cases when this is realized with a standalone device, and cases when this is realized by combining a plurality of devices, and items that include the various modes.

What is claimed is:

1. A printing device printing media based on print job data, comprising:

a conveyance unit having a rotation unit, the conveyance unit being configured to extract the media from a media placement unit and convey the extracted media according to the rotation of the rotation unit, a recording head configured to print a plurality of sheets of the media based on the print job data, and a control unit configured to control recording by the recording head and the rotation of the rotation unit, and configured to count a number of sheets of the media that has been printed by the recording head based on the print job data, the control unit switching the rotation speed of the rotation unit according to the number of sheets of the media that has been counted, while the plurality of the sheet of the media are printed based on the print job data.

2. A printing device for spraying ink drops on media from a recording head and printing based on print job data, comprising:

a conveyance unit for extracting the media from a media placement unit and conveying the extracted media according to the rotation of a rotation means, and a control unit for controlling spraying of the ink drops from the recording head and rotation of the rotation means, wherein the control unit switches the rotation speed of the rotation means according to the number of sheets of the media printed based on the print job data when the print job data indicates printing on a plurality of sheets of the media, and the control unit rotates the rotation means at the rotation speed according to a first mode when the number of sheets is less than a standard sheet count, and rotates the rotation means at the rotation speed according to a second mode for conveying the media which is faster than the first mode when the number of sheets is the standard sheet count or greater.

3. The printing device according to claim 2, wherein the control unit sums up the number of sheets to count for the first print job data when printing based on the second print job data within a designated elapsed time after printing the media based on the first print job data and ejecting it.

4. The printing device according to claim 2, wherein the standard sheet count is changeable by a designated operation.

5. The printing device according to claim 2, wherein the standard sheet count is four.

6. The printing device according to claim 1, wherein the control unit switches the rotation speed of the rotation unit according to the number of sheets of the media printed based on the print job data when the print job data indicates printing on a plurality of sheets of the media.

7. The printing device according to claim 1, wherein the control unit switches the rotation speed of the rotation unit according to the number of sheets of the media printed based on a plurality of print job data that indicate printing on a plurality of sheets of the media, wherein the plurality of print job data including the print job data.

* * * * *